US007412969B2

(12) United States Patent
Pena et al.

(10) Patent No.: US 7,412,969 B2
(45) Date of Patent: Aug. 19, 2008

(54) DIRECT NEEDLE CONTROL FUEL INJECTORS AND METHODS

(75) Inventors: James A. Pena, Encinitas, CA (US); Tibor Kiss, Manitou Springs, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 0 days.

(21) Appl. No.: 11/717,300

(22) Filed: Mar. 13, 2007

(65) Prior Publication Data

US 2007/0246014 A1 Oct. 25, 2007

Related U.S. Application Data

(60) Provisional application No. 60/782,030, filed on Mar. 13, 2006.

(51) Int. Cl.
*F02M 59/46* (2006.01)
*F02M 59/44* (2006.01)

(52) U.S. Cl. ..... 123/467; 123/506

(58) Field of Classification Search ..... 123/467, 123/472, 478, 506; 239/533.1, 533.3, 533.7, 239/533.8, 533.9, 533.12, 88–92
See application file for complete search history.

(56) References Cited

U.S. PATENT DOCUMENTS 4,440,132 A 4/1984 Terada et al.
5,341,783 A 8/1994 Beck et al.
5,423,484 A 6/1995 Zuo
5,460,329 A * 10/1995 Sturman ..... 239/96
5,669,355 A 9/1997 Gibson et al.
5,682,858 A 11/1997 Chen et al.
5,687,693 A 11/1997 Chen et al.
5,697,342 A 12/1997 Anderson et al.
5,722,373 A 3/1998 Paul et al.
5,727,525 A 3/1998 Tsuzuki
5,732,679 A * 3/1998 Takahasi et al. ..... 123/467
5,738,075 A 4/1998 Chen et al.
5,771,865 A * 6/1998 Ishida ..... 123/467
5,779,149 A * 7/1998 Hayes, Jr. ..... 239/124
5,826,562 A 10/1998 Chen et al.
5,941,215 A * 8/1999 Augustin ..... 123/467
5,954,030 A 9/1999 Sturman et al.

(Continued)

FOREIGN PATENT DOCUMENTS

DE 102 50 130 A1 3/2004

(Continued)

*Primary Examiner*—Mahmoud Gimie
(74) *Attorney, Agent, or Firm*—Blakely Sokoloff Taylor & Zafman LLP

(57) ABSTRACT

Direct needle control fuel injectors and methods disclosed. The preferred embodiment injectors have a needle within a needle chamber for movement between a closed position preventing injection of fuel and an open position allowing injection of fuel, a source of high pressure fuel coupled to the needle chamber to provide fuel for injection and to hydraulically urge the needle to the open position by pressurizing a first hydraulic area associated with the needle, a needle control hydraulic area having a second hydraulic area disposed to urge the needle to the closed position when the second hydraulic area is exposed to fuel under pressure, and valving coupled to the source of high pressure fuel and a vent to controllably couple the hydraulic area of the needle control member to the high pressure fuel or to the vent.

9 Claims, 1 Drawing Sheet

U.S. PATENT DOCUMENTS

| | | | | |
|---|---|---|---|---|
| 5,970,956 | A | 10/1999 | Sturman | |
| 6,012,644 | A | 1/2000 | Sturman et al. | |
| 6,027,047 | A * | 2/2000 | Augustin | 239/533.3 |
| 6,112,721 | A | 9/2000 | Kouketsu et al. | |
| 6,113,014 | A | 9/2000 | Coldren et al. | |
| 6,161,770 | A | 12/2000 | Sturman | |
| 6,257,499 | B1 | 7/2001 | Sturman | |
| 6,308,690 | B1 | 10/2001 | Sturman | |
| 6,360,728 | B1 | 3/2002 | Sturman | |
| 6,557,506 | B2 | 5/2003 | Sturman | |
| 6,575,126 | B2 | 6/2003 | Sturman | |
| 6,684,853 | B1 | 2/2004 | Lei | |
| 6,745,958 | B2 | 6/2004 | Lei | |
| 6,845,926 | B2 | 1/2005 | Lei | |
| 7,108,200 | B2 | 9/2006 | Sturman | |
| 7,182,068 | B1 | 2/2007 | Sturman et al. | |
| 2004/0000600 | A1 * | 1/2004 | Peters et al. | 239/533.2 |

FOREIGN PATENT DOCUMENTS

| | | | |
|---|---|---|---|
| DE | 10 2004 030 447 | A1 | 1/2006 |
| DE | 10 2005 028 400 | A1 | 2/2006 |
| DE | 10 2005 060 647 | A1 | 6/2006 |
| EP | 1 593 839 | A1 | 11/2005 |

* cited by examiner

DIRECT NEEDLE CONTROL FUEL INJECTORS AND METHODS

CROSS-REFERENCE TO RELATED APPLICATION

This application claims the benefit of U.S. Provisional Patent Application Ser. No. 60/782,030 filed Mar. 13, 2006.

BACKGROUND OF THE INVENTION

1. Field of the Invention

The present invention relates to the field of fuel injectors.

2. Prior Art

Conventional 2-way needle control valves to control the motion of a diesel injector's needle valve have been in use for quite some years. They provide acceptable but not superior controllability with relatively low cost. On the other hand, needle control with 3-way valves has not been commercialized to the same extent. They provide superior flexibility in controlling the needle motion, but with relatively higher cost.

Direct needle control with 2-way valves is relatively simpler and lower cost. However, the flexibility in controlling the needle motion during both opening and closing through the entire pressure range is not optimal.

Previous direct needle control injectors with 3-way valves achieved superior needle controlling flexibility, but they were complex and costly. Also, the orifice determining the needle opening velocity is farther from the needle control volume than ideal.

DETAILED DESCRIPTION OF THE PREFERRED EMBODIMENTS

Diesel injectors with independent control of needle valve opening and closing velocity with a simple low cost design are disclosed.

Figure 1:
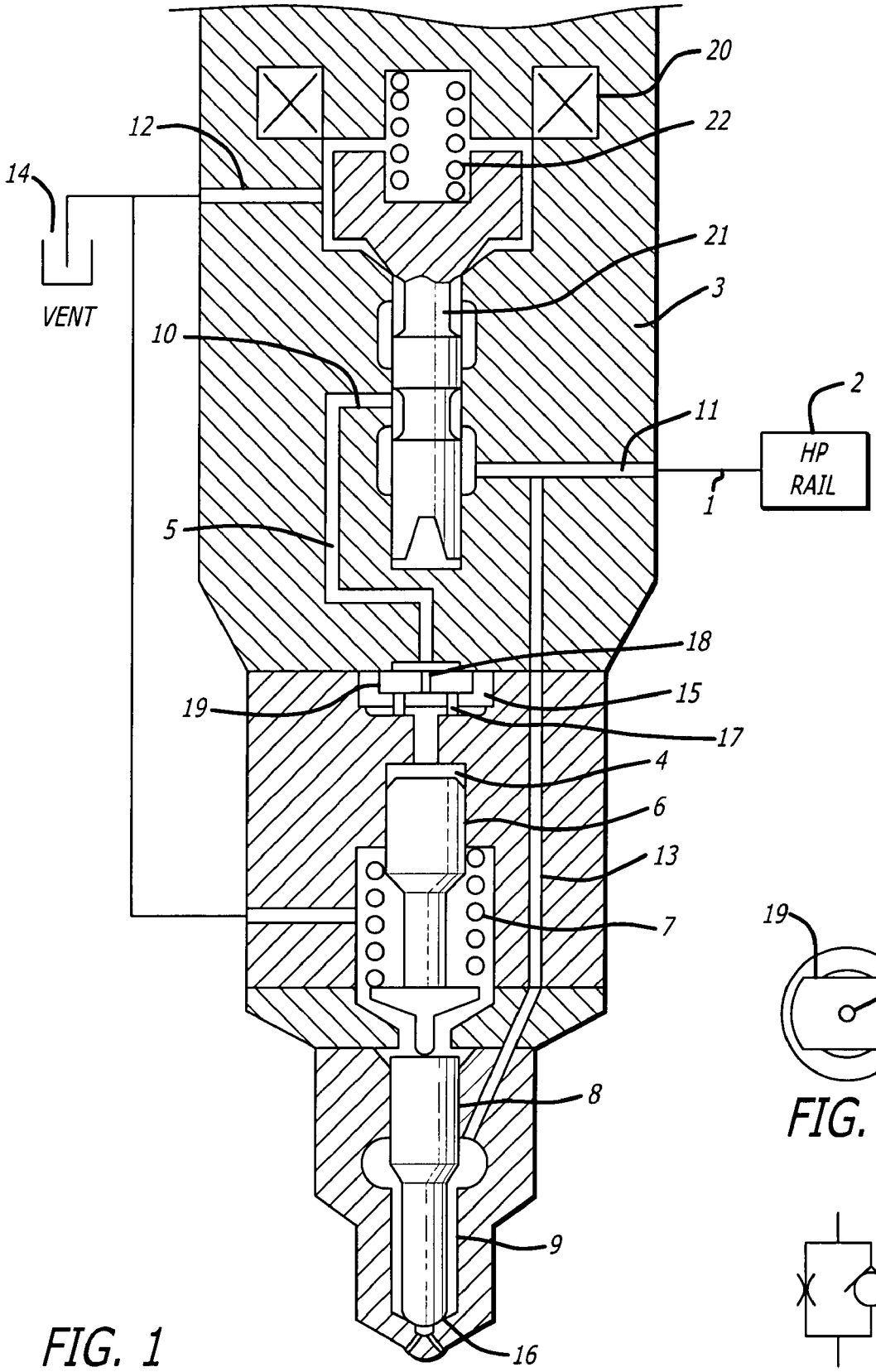
FIG. 1 is a cross section of a preferred embodiment of the present invention.

As shown in FIG. 1, the main components of the new injectors are a high pressure fuel supply reservoir 2, an electromagnetically actuated 3-way control valve 3, a needle control volume 4, a needle pin 6, a needle spring 7, a needle 8, a fuel volume around the needle 9, a vent volume 14. essentially at ambient pressure, and a check disk 15. A hydraulic line 13 connects the reservoir 2 with the fuel volume 9 around the needle 8. The needle control valve has 3 ports. The supply port 11 is connected to the supply reservoir 2 through hydraulic line 1, the control port 10 is connected to the needle control volume 4 through a hydraulic line 5 and the check disk 15, and the vent port 12 is connected to the vent 14. The needle control valve has a supply and a vent position, and is normally (when not energized) in the supply position as shown. In the supply position, the valve connects the control port 10 with the supply port 11, and therefore connects the high pressure fuel in the supply reservoir 2 to the control volume 4. In the vent position, the valve connects the control port 10 to the vent port 12, and therefore connects the control volume 4 to the vent 14. In the supply position, the high pressure in the control volume 4 keeps the needle 8 on its seat, thereby preventing fuel from entering the engine cylinder. When injection is commanded by an engine control unit, a current pulse is applied to the magnetic coil 20 of the valve 3 and the spool poppet 21 moves from the supply position to the vent position, coupling the control volume 4 over the needle 8 to the vent port 12. Thus the pressure drops in the control volume 4, though because the volume 9 around the needle is still coupled to the high pressure rail 2, the needle 8 will lift. Since the fluid volume around the needle 9 is still directly connected to the high pressure supply reservoir 2, an injection event begins.

Figure 2:
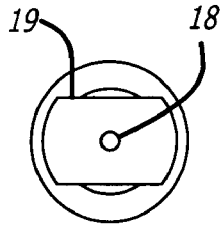
FIG. 2 is a bottom view of the check disc 15.
Figure 3:
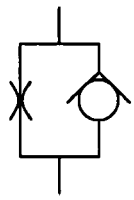
FIG. 3 is a functional diagram for the operation of the check disk 15.

When end of injection is commanded, the current pulse is terminated by the engine control unit, the spool poppet 21 moves to the supply position by the action of spring 22, the control volume 4 is re-pressurized, and the needle 8 moves down and settles on its seat 16 to end the injection event. The check disk 15 is able to move between its lower stop and upper stop according to the pressure differential between above and below the check disk. The check disk is biased with a small wave spring 17 to be against its upper stop when the pressure is balanced. The check disk is made such that when it is on its upper stop, the only flow path is through an orifice hole 18 in the center of the check disk. When the check disk is against its lower stop, the flow path through the check includes the same orifice, but also around the cuts or flats 19 on the sides of the check disk (see FIG. 2 for a bottom view of the check disk). This design allows independent setting for the two flow areas., the only restriction being that the flow area in the check disk's lower position has to be higher, and typically, the check disk would be made such that this flow area would be several times higher than the center orifice 18 flow area. A functional diagram of the check disk 15 is shown in FIG. 3, and effectively functions as a check valve with a predetermined "leak" in the check valve upper condition.

When flow is going away from the control volume 4 (start of injection), the pressure forces keep the check disk 15 against its upper stop, in which case the flow area is low, the pressure drop across the check disk is high. The result is a relatively slow upward movement of the needle. When flow is going toward the control volume 4 (end of injection), the pressure force holds the check disk against the lower stop, the flow area is large, and therefore the pressure drop across the check disk is low. The result is fast downward (closing) needle motion.

The combination of slower needle opening and faster needle closing velocity is advantageous. First, it allows achieving very small injection quantities across the rail operating pressure range. Second, the fast closing on its own helps lower the particulate emissions because of the very low amount of fuel injected at low injection pressure. These favorable needle velocities can be achieved over a larger pressure range than with a 2-way needle control. Compared to 3-way control without the check disk, the orifice 18 setting needle opening velocity is closer to the needle control volume which can be helpful in achieving small injection quantities.

Thus the present invention combines the following attributes:

1. Relatively simple 3-way valve with low leakage because of the use of a combined spool/poppet valve 3, the poppet valve preventing typical spool valve leakage except during an injection event. Preferably the spool valve lands are positioned to close one connection before opening the other so that a short circuit (flow directly from the high pressure source to drain) is prevented.

2. Low cost due to relative simplicity of the injector.

3. Superior needle velocity control due to the selectively different forward and backward flow areas through the check disk.

Note that while the check disk 15 in the embodiment disclosed is spring biased, the check disk may or may not be spring biased, as desired, though a spring bias helps predetermine the position of the check disk 15.

The high pressure fuel reservoir supplying the,injector can be high pressure common rail supplying all injectors on a particular engine,.or it could be the intensified fluid volume of a hydraulic intensifier dedicated to a particular injector on the engine. Accordingly the reservoir 2 is schematic only, representing a source of high pressure fuel, whether from a high pressure rail, an intensifier for the individual injector, or some other source of high pressure fuel. If the high pressure fuel is provided by an intensifier associated with the injector, then typically the intensifier would be activated just before an injection event and deactivated just after the injection event, the needle spring 7 holding the needle closed when the fuel pressure drops between intensification events. Obviously for proper operation of the injector, regardless of the source of the high pressure fuel, the hydraulic area of the control volume 4 over the needle pin 6 must be large enough relative to the hydraulic area exposed to fuel in the fuel volume around the needle 9 tending to raise the needle 8 from its closed position by an amount at least adequate for the combination of hydraulic forces and the force of needle spring 7 to hold the needle 8 down (closed) between injection events. Typically the hydraulic area of the control volume 4 over the needle pin 6 will be as large or larger than the hydraulic area exposed to fuel in the fuel volume around the needle 9 tending to raise the needle 8 from its closed position.

The direct needle control valve 3 could be any 3-way type valve, including a valve with an armature, conventional spool type, 2-coil valve with no spring return, etc. However, it is believed that other valves would be inferior compared to the one presented in the preferred embodiment of this invention shown in FIG. 1. In particular note that the valve 3 couples the control volume 4 to the high pressure rail most of the time, injection occurring in a four cycle diesel engine over perhaps a 90 degree rotation of the crankshaft for every 720 degree rotation of the crankshaft. The poppet valve at the end of the spool provides very low leakage, so preserves the advantages of a spool valve with the low leakage of the poppet valve that is closed most of the time to minimize valve leakage.

The fuel pin could be eliminated and the needle control volume could be directly on top of the needle if an orifice is introduced into the line going to the nozzle.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A fuel injector comprising:

a needle within a needle chamber for movement between a closed position preventing injection of fuel and an open position allowing injection of fuel;

a source of high pressure fuel coupled to the needle chamber to provide fuel for injection and to hydraulically urge the needle to the open position by pressurizing a first hydraulic area associated with the needle;

a needle control hydraulic area having a second hydraulic area disposed to urge the needle to the closed position when the needle control hydraulic area is exposed to fuel under pressure; and, a spool poppet valve having a spool valve housing with a spool valve member therein having a poppet valve at one end thereof and moveable between first and second positions, the spool valve housing having a poppet valve seat disposed to cooperate with the poppet valve when the spool valve member is in the first position to block fuel flow through the poppet valve seat;

the poppet valve member being coupled to fuel under pressure and to the needle control hydraulic area, the poppet valve seat being coupled to a low pressure vent, the poppet valve member being configured to couple fuel under pressure to the needle control hydraulic area and to block fuel flow from the needle control hydraulic area to the poppet valve seat when in the first position, and to block fuel under pressure from the needle control hydraulic area and to couple the needle control hydraulic area to the poppet valve seat when in the second position.

2. The fuel injector of claim 1 further comprised of a spring disposed to urge the needle to the closed position.

3. The fuel injector of claim 1 wherein the needle control hydraulic area is larger than the hydraulic area that will urge the needle to the open position.

4. The fuel injector of claim 3 further comprising a check valve allowing relatively unrestricted flow of high pressure fuel from the source of high pressure fuel to the needle control hydraulic area, and relatively restricted flow from the needle control hydraulic area back to the vent.

5. The fuel injector of claim 1 wherein the position of the spool valve member is controlled by a solenoid actuator.

6. A fuel injector comprising:

a needle within a needle chamber for movement between a closed position preventing injection of fuel and an open position allowing injection of fuel;

a source of high pressure fuel coupled to the needle chamber to provide fuel for injection and to hydraulically urge the needle to the open position by pressurizing a first hydraulic area associated with the needle;

a needle control hydraulic area having a second hydraulic area disposed to urge the needle to the closed position when the needle control hydraulic area is exposed to fuel under pressure; and, a spool poppet valve having a spool valve housing with a spool valve member therein having a poppet valve at one end thereof and moveable between first and second positions, the spool valve housing having a poppet valve seat disposed to cooperate with the poppet valve when the spool valve member is in the first position to block fuel flow through the poppet valve seat, and to allow fuel flow through the poppet valve seat when the spool valve member is in the second position;

the poppet valve member being coupled to fuel under pressure and to the needle control hydraulic area, the poppet valve seat being coupled to a low pressure vent, the poppet valve member being configured to couple fuel under pressure to the needle control hydraulic area and to block fuel flow from the needle control hydraulic area to the poppet valve seat when in the first position, and to block fuel under pressure from the needle control hydraulic area and to couple the needle control hydraulic area to the poppet valve seat when in the second position; and, a solenoid actuator coupled to control the position of the spool valve member.

7. The fuel injector of claim 6 further comprised of a spring disposed to urge the needle to the closed position.

8. The fuel injector of claim 6 wherein the needle control hydraulic area is larger than the hydraulic area that will urge the needle to the open position.

9. The fuel injector of claim 8 further comprising a check valve allowing relatively unrestricted flow of high pressure fuel, from the source of high pressure fuel to the needle control hydraulic area, and relatively restricted flow from the needle control hydraulic area back to the vent.

* * * * *